US007643769B2

(12) United States Patent
Akazawa

(10) Patent No.: US 7,643,769 B2
(45) Date of Patent: Jan. 5, 2010

(54) IMAGE FORMING SYSTEM, AN APPARATUS, AND METHOD FOR CONTROLLING THE SAME

(75) Inventor: Minoru Akazawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 272 days.

(21) Appl. No.: 11/756,277

(22) Filed: May 31, 2007

(65) Prior Publication Data

US 2008/0044191 A1 Feb. 21, 2008

(30) Foreign Application Priority Data

Jun. 21, 2006 (JP) ..... 2006-171508

(51) Int. Cl.
*G03G 15/00* (2006.01)

(52) U.S. Cl. ..... 399/82; 399/8; 399/12; 399/81; 399/84

(58) Field of Classification Search ..... 399/18, 399/19, 38, 82
See application file for complete search history.

(56) References Cited

U.S. PATENT DOCUMENTS 6,078,759 A * 6/2000 Satake et al. ..... 399/8
7,180,623 B2 2/2007 Kazunori
2002/0031364 A1* 3/2002 Suzuki et al. ..... 399/75
2003/0210920 A1* 11/2003 Kuga ..... 399/82

FOREIGN PATENT DOCUMENTS

JP 10-136143 A 5/1998
JP 2001-018495 A 1/2001
JP 2003-167719 A 6/2003
JP 2003-198781 A 7/2003

* cited by examiner

*Primary Examiner*—David M Gray
*Assistant Examiner*—Roy Yi
(74) *Attorney, Agent, or Firm*—Canon U.S.A. Inc., I.P. Division

(57) ABSTRACT

When a printing process on a first apparatus is interrupted due to an error and the printing process is resumed by a second apparatus, it is determined whether a predetermined function (for example, stapling) is selected for the printing process according to the printing mode. If the predetermined function is selected for the printing process, the second printing apparatus prints the number of copies including the copy interrupted in the first machine according to the print setting. If the predetermined function is not selected for the printing process, the second printing apparatus prints the number of copies excluding the interrupted copy and the unprinted pages in the interrupted copy according to the print setting.

9 Claims, 9 Drawing Sheets

IMAGE FORMING SYSTEM, AN APPARATUS, AND METHOD FOR CONTROLLING THE SAME

BACKGROUND OF THE INVENTION

1. Field of the Invention

The present invention relates to image forming systems capable of printing copies of image data read by a copier using a plurality of copiers on a job-sharing basis, and relates to methods for controlling image forming systems.

2. Description of the Related Art

A function of printing copies of image data read by one copier using a plurality of copiers by sharing the copies among the plurality of copiers is well known. Such a function is referred to as, for example, cascade copying. When cascade copying is used for printing, ten copies of an original, for example, images represented by image data read by a scanner of a copier A can be printed by each of the copier A and a copier B in two groups of five. Thus, printing can be finished in half the time of printing using only one copier.

When an error such as a paper jam, a run out of paper error, and a run out of toner error that prevents continuation of the printing process occurs in one of the copiers during cascade copying, the rest of the copies that were to be printed by the copier having the error can be printed by the other copier instead (substitution copying; see, for example, Japanese Patent Laid-Open No. 2003-198781).

This function will now be described in detail with reference to FIGS. 1A to 1D. For example, a user has an original document of one hundred pages, and wants to make ten copies of the document (FIG. 1A). When the user uses the above-described cascade copying function, image data read by the copier A is sent to the copier B, and each of the copier A and the copier B prints five copies of the document (FIG. 1B). When an error such as a paper jam occurs in the copier B at the moment of finishing printing of the eightieth page of the third copy, substitution copying is performed (FIG. 1C). More specifically, when the copier A receives an error notification from the copier B, the copier A is set to print three extra copies that have not been printed by the copier B in addition to the five copies already allocated to the copier A (FIG. 1C). That is, the copier A prints the copies that have not been printed by the copier B instead of the copier B. In the above-described technology, eight copies of the document are printed by the copier A, and two copies and eighty pages that do not constitute a complete copy are printed by the copier B when the printing is finished. That is, eighty extra pages are unnecessarily printed by the copier B due to substitution copying carried out in response to the occurrence of an error (FIG. 1D) although ten copies of one hundred pages were originally intended to be printed.

As described above, when substitution copying is performed in units of copies upon the occurrence of an error during cascade copying, extra outputs that do not constitute a complete copy can be produced.

SUMMARY OF THE INVENTION

The present invention provides an image forming system capable of selectively performing an appropriate substitution process according to process details of specified printing when a substitution process is performed upon the occurrence of an error during cascade copying.

According to an aspect of the present invention, an image forming system including a first apparatus and a second apparatus, the first apparatus reads an image of an original document, the read image data is transmitted to the second apparatus, the image forming system capable of controlling a printing mode in which printing of a plurality of copies of the read image data is performed using the first apparatus and the second apparatus, the image forming system includes a determining unit configured to determine whether a predetermined function is selected on a printing process according to the printing mode in a case that an error occurs in one of the first apparatus and the second apparatus is printing one of the plurality of copies, and a control unit configured to control the other of the first apparatus and the second apparatus to print page which is not printed in the one of the plurality of copies without printing page which is printed by the one of the first apparatus and the second apparatus in the one of the plurality of copies in a case that the determining unit determines that the predetermined function is not selected, and to control the other of the first apparatus and the second apparatus to print page which is not printed in the one of the plurality of copies with printing page which is printed by the one of the first apparatus and the second apparatus in the one of the plurality of copies in a case that the determining unit determines that the predetermined function is selected.

According to another aspect of the present invention, an apparatus connected to the other apparatus includes a receiving unit configured to receive image data read by the other apparatus, a printing unit configured to print the image data received by the receiving unit based on information on a plurality of copies specified in the other apparatus, a control unit configured to control a printing mode in which printing of a plurality of copies of the read image data is performed using the other apparatus and the printing unit, a determining unit configured to determine whether a predetermined function is selected on a printing process according to the printing mode in a case that an error occurs during the printing unit is printing one of the plurality of copies, and a notifying unit configured to notify the other apparatus of the one of the plurality of copies in a case that the determining unit determines that the predetermined function is selected, and to notify the other apparatus of the one of the plurality of copies and the number of unprinted pages in the one of the plurality of copies the determining unit determines that the predetermined function is not selected.

According to another aspect of the present invention, an apparatus connected to the other apparatus includes a reading unit configured to read an image of an original document, a printing unit configured to print the image data read by the reading unit, a control unit configured to send the image data read by the reading unit to the other apparatus, and to control a printing mode in which printing of a plurality of copies of the read image data is performed using the other apparatus and the printing unit, a receiving unit configured to receive information indicating occurrence of an error from the other apparatus in a case that an error occurs in the other apparatus during the other apparatus is printing one of the plurality of copies, and a determining unit configured to determine whether a predetermined function is selected on a printing process according to the printing mode in response to the receipt of the information by the receiving unit, wherein the printing unit prints page which is not printed in the one of the plurality of copies without printing page which is printed by the other apparatus in the one of the plurality of copies in a case that the determining unit determines that the predetermined function is not selected, and the printing unit prints page which is not printed in the one of the plurality of copies with printing page which is printed by the other apparatus in the one of the plurality of copies in a case that the determining unit determines that the predetermined function is selected.

Other features and advantages of the present invention will be apparent from the following description when taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DESCRIPTION OF THE EMBODIMENTS

Exemplary embodiments of the present invention will now be described with reference to the drawings.

First Exemplary Embodiment

Figure 1A:
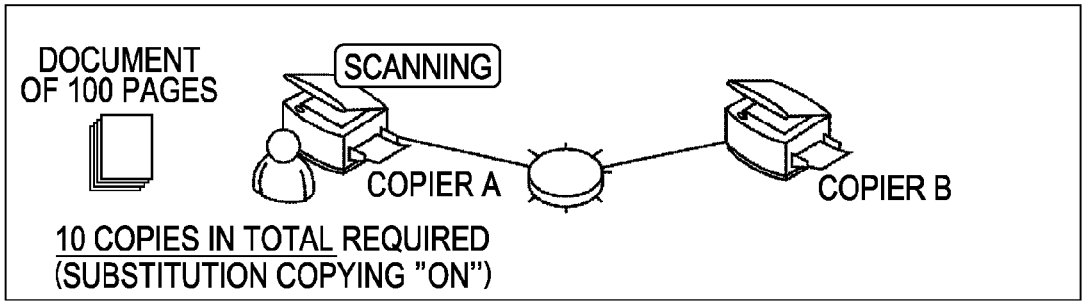
FIGS. 1A to 1D illustrate operations of substitution copying during cascade copying upon the occurrence of an error according to a known technology.
Figure 1B:
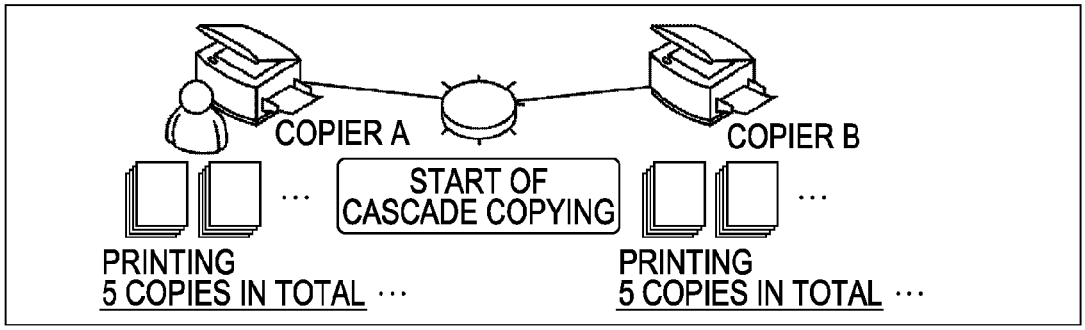
Figure 1C:
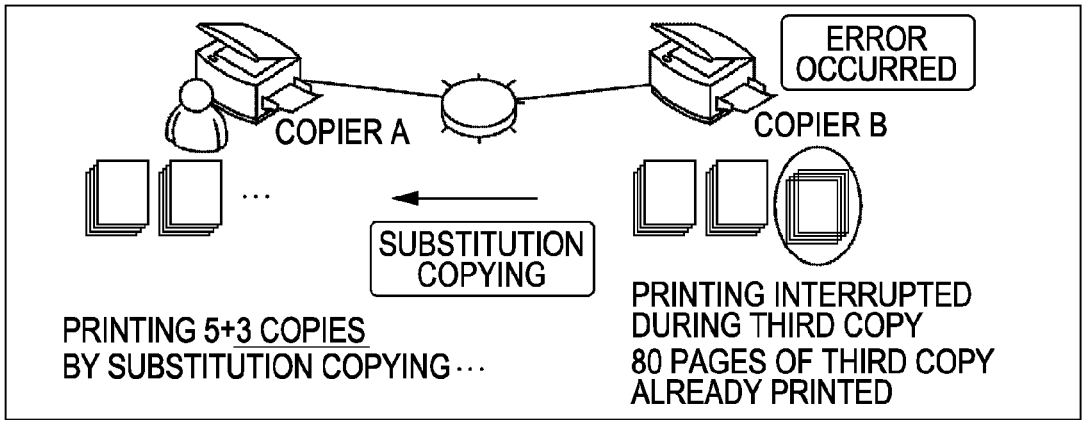
Figure 1D:
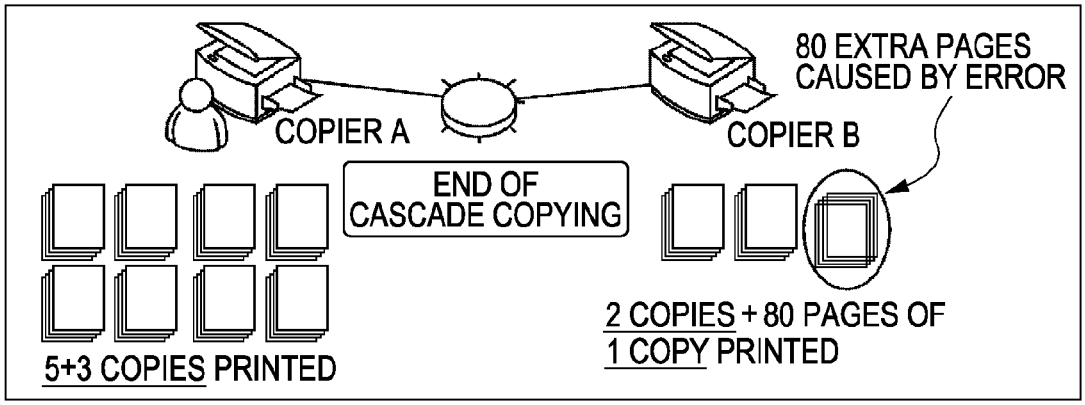
Figure 2:
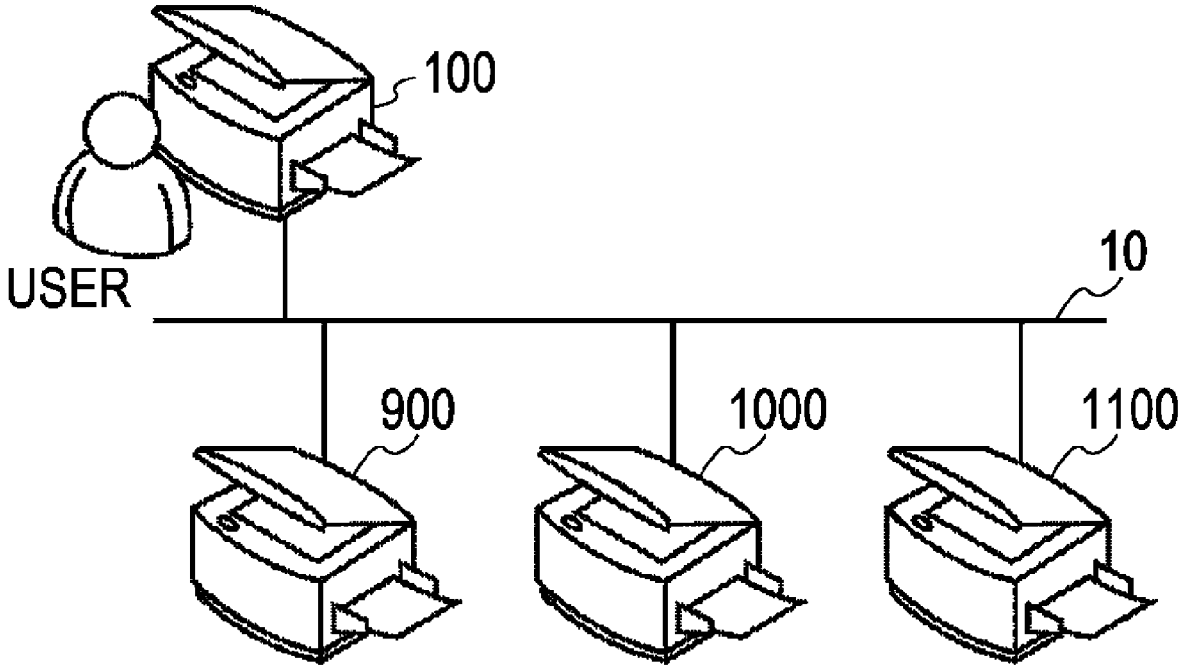
FIG. 2 illustrates a system configuration according to a first exemplary embodiment of the present invention.

FIG. 2 illustrates a system configuration according to this exemplary embodiment.

In the system shown in FIG. 2, a copier 100 named Office 1 is connected to a copier 900 named Office 2, a copier 1000 named Office 3, and a copier 1100 named Office 4 via a local area network (LAN) 10.

The copier 100 has an image-scanning function and a printing function, and can send the read image data to the copiers 900, 1000, and 1100 via the LAN 10. The copiers 900, 1000, and 1100 print on the basis of the image data sent by the copier 100 via the LAN 10. Such a function of printing image data read by a copier using a plurality of copiers including the copier that read the image data on a job-sharing basis is referred to as cascade copying. In this exemplary embodiment, this function will be described as cascade copying hereinafter. Moreover, during cascade copying, the copier that read image data is referred to as a local machine, and the copiers that receive the image data sent by the local machine and print on the basis of the image data are referred to as remote machines.

Each one of the copiers 100, 900, 1000, and 1100 can perform cascade copying, and can operate as a local machine or a remote machine. The copier serving as a local machine has IP addresses of remote machines registered therein so as to communicate with the remote machines. When the copier 100 serving as a local machine performs cascade copying using the copier 900, the copier 900 is selected as a remote machine via an operation panel of the copier 100. Subsequently, the number of copies is set, and an instruction for image scanning is issued. With this, the original document is scanned, and the copiers 100 and 900 each print half the total number of copies. When the number of copies is odd, one additional copy is allocated to the local machine.

In this exemplary embodiment, copiers serve as image forming apparatuses that perform cascade copying. However, the image forming apparatuses are not limited to copiers, and can be any other apparatuses such as multifunctional apparatuses and facsimiles as long as the apparatuses have an image-scanning function and a printing function. Moreover, apparatuses serving only as the remote machines need to have only the printing function, and can be printers and the like. Moreover, the connection among the image forming apparatuses that perform cascade copying is not limited to that via LAN, and can be those via the Internet and a wide area network (WAN). Moreover, the image forming apparatuses can be directly connected to each other via a serial or parallel interface.

Next, a hardware configuration of the copier 100 according to this exemplary embodiment will be described with reference to FIG. 3. The copiers 900, 1000, and 1100 also have the same configuration.

Figure 3:
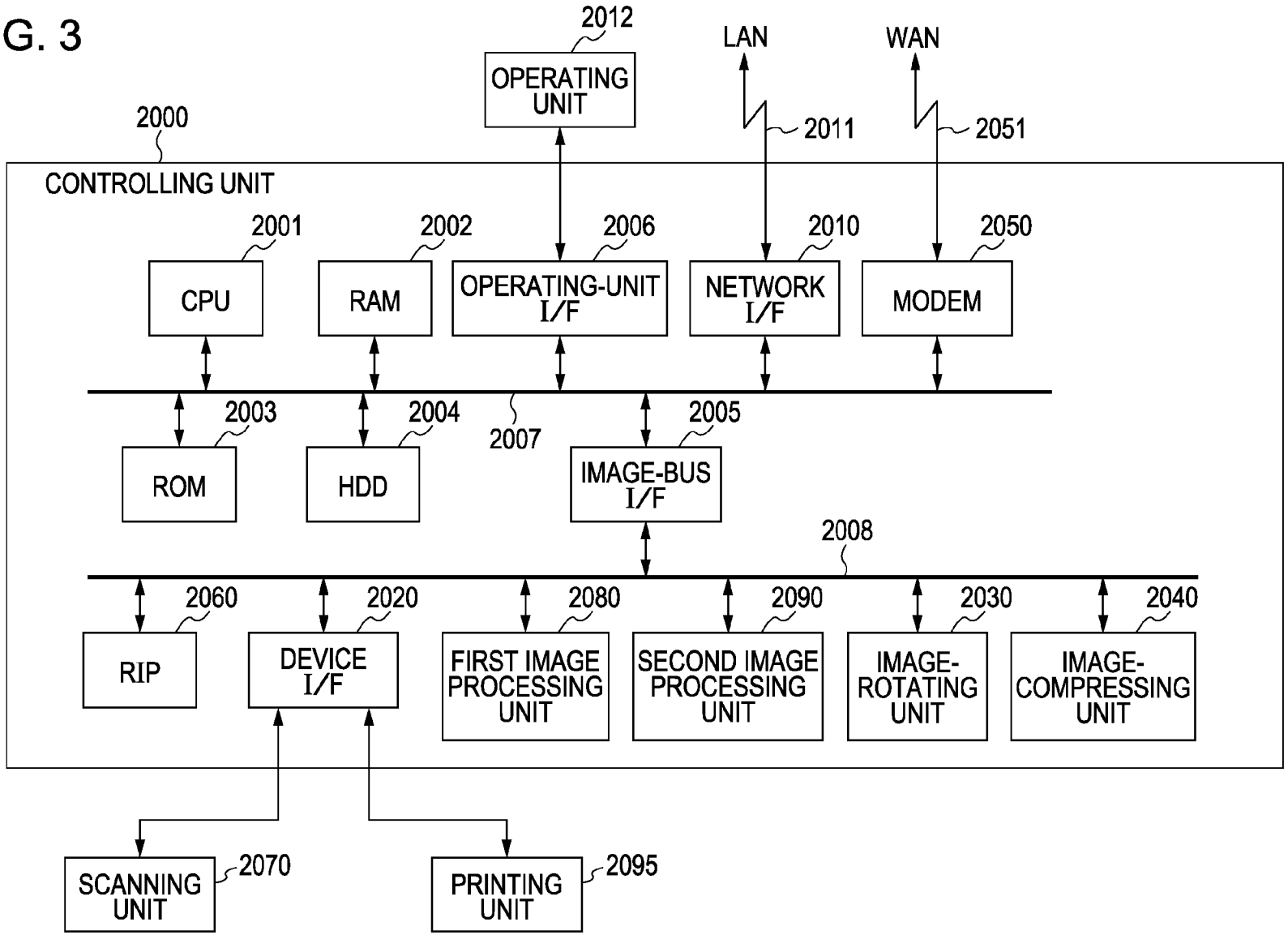
FIG. 3 illustrates a hardware configuration of a copier according to the first exemplary embodiment.

In FIG. 3, a controlling unit 2000 is connected to a scanning unit 2070 serving as an image-input device and a printing unit 2095 serving as an image-output device. Furthermore, the controlling unit 2000 is connected to a LAN 2011 and a public line (WAN) 2051 so as to input and output image data and other data.

In the controlling unit 2000, a central processing unit (CPU) 2001 is a controller that controls the system of the copier. A random-access memory (RAM) 2002 is a working memory used for the operation of the CPU 2001, and is also an image memory in which image data is temporarily stored. A read-only memory (ROM) 2003 is a boot ROM that stores a boot program of the system. A hard disk drive (HDD) 2004 stores system software, image data, and the like.

An operating-unit interface (I/F) 2006 is an interface with an operating unit 2012, and outputs display data to be displayed on the operating unit 2012 to the operating unit 2012. Moreover, the operating-unit I/F 2006 transmits information input by users of this system via the operating unit 2012 to the CPU 2001. A network I/F 2010 is connected to the LAN 2011 so as to input and output information. A modem 2050 is connected to the WAN 2051 so as to input and output information. The above-described devices are disposed on a system bus 2007.

An image-bus I/F 2005 is a bus bridge that connects the system bus 2007 and an image bus 2008 and converts data structures. The image bus 2008 is a PCI bus or an IEEE 1394 bus, and transmits image data at high speed. The image bus 2008 includes the following devices.

A raster image processor (RIP) 2060 converts page-description language (PDL) code into bitmap images. A device I/F 2020 connects the scanning unit 2070 and the printing unit 2095 to the controlling unit 2000, and performs synchronous/asynchronous conversions of image data. The scanning unit 2070 serves as a scanner that scans original documents and generates image data to be transmitted to other copiers. A first image processing unit 2080 corrects, processes, or edits the image data read by the scanning unit 2070. A second image processing unit 2090 corrects the image data to be printed by the printing unit 2095, or converts the resolution of the image data. An image-rotating unit 2030 rotates image data. An image-compressing unit 2040 compresses multi-valued image data to JPEG and expands JPEG to multi-valued image data, or compresses binary image data to JBIG, MMR, or MH and expands JBIG, MMR, or MH to binary image data.

Figure 4:
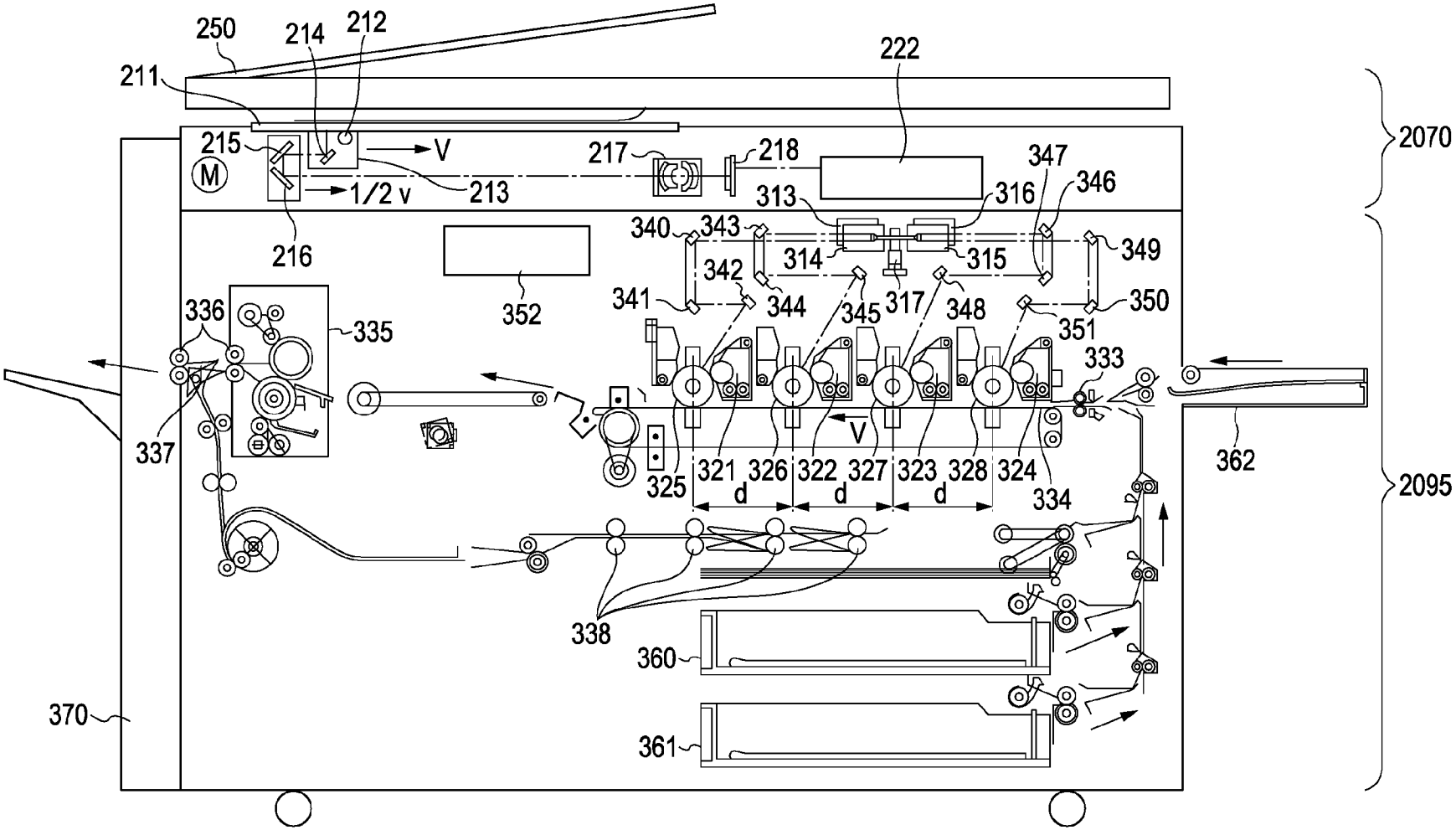
FIG. 4 illustrates a scanning unit and a printing unit in the copier according to the first exemplary embodiment.

FIG. 4 is a view of the scanning unit 2070 and the printing unit 2095. A document-conveying unit 250 of the scanning unit 2070 supplies sheets of an original document to a platen glass 211 one by one in ascending order, and removes the sheets from the platen glass 211 after scanning of the sheets is finished. When a sheet is conveyed onto the platen glass 211, a lamp 212 is lit, and an optical unit 213 starts moving so as to scan the sheet. The light reflected from the sheet at this moment is guided to a charge-coupled device (CCD) image sensor (herein after referred to as CCD) 218 by mirrors 214 to 216 and a lens 217. In this manner, images of the scanned document are read by the CCD 218.

A first image-processing circuit 222 of the scanning unit 2070 performs predetermined processing on digital image data (red (R), green (G), and blue (B)) output from the CCD 218, and outputs the data to the controlling unit 2000.

A second image-processing circuit 352 of the printing unit 2095 outputs the image data (cyan (C), magenta (M), yellow (Y), and black (K)) sent by the controlling unit 2000 to a laser driver 317.

The laser driver 317 of the printing unit 2095 drives laser-emitting portions 313 to 316 to emit laser light according to the image data output from the second image-processing circuit 352. The laser light is incident on photosensitive drums 325 to 328 using mirrors 340 to 351 such that latent images according to the laser light are formed on the photosensitive drums 325 to 328. Developing units 321 to 324 develop the latent images using toners of C, M, Y, and K, respectively, and the developed toners are transferred to sheets. In this manner, full-color copies are produced.

Sheets are supplied from any one of sheet cassettes 360 and 361 and a manual-feeding tray 362 in synchronization with the start of the laser emission, pass through registration rollers 333, and adhere to a transfer belt 334 so as to be conveyed. The toners applied to the photosensitive drums 325 to 328 are transferred to the recording sheets. The recording sheets having the toner transferred thereto are conveyed to a fixing unit 335, and the toners are fixed to the recording sheets using the heat and pressure of the fixing unit 335. The recording sheets passing through the fixing unit 335 are discharged by ejecting rollers 336. An output unit 370 sorts the recording sheets by bundling the discharged recording sheets, and staples the sorted recording sheets. When a duplex-printing function is selected, the recording sheets are conveyed to the position of the ejecting rollers 336, and then guided to a refeeding path 338 by a flapper 337 by rotating the ejecting rollers 336 in a reverse direction. The recording sheets guided to the refeeding path 338 are supplied to the transfer belt 334 at the above-described timing.

Figure 5:
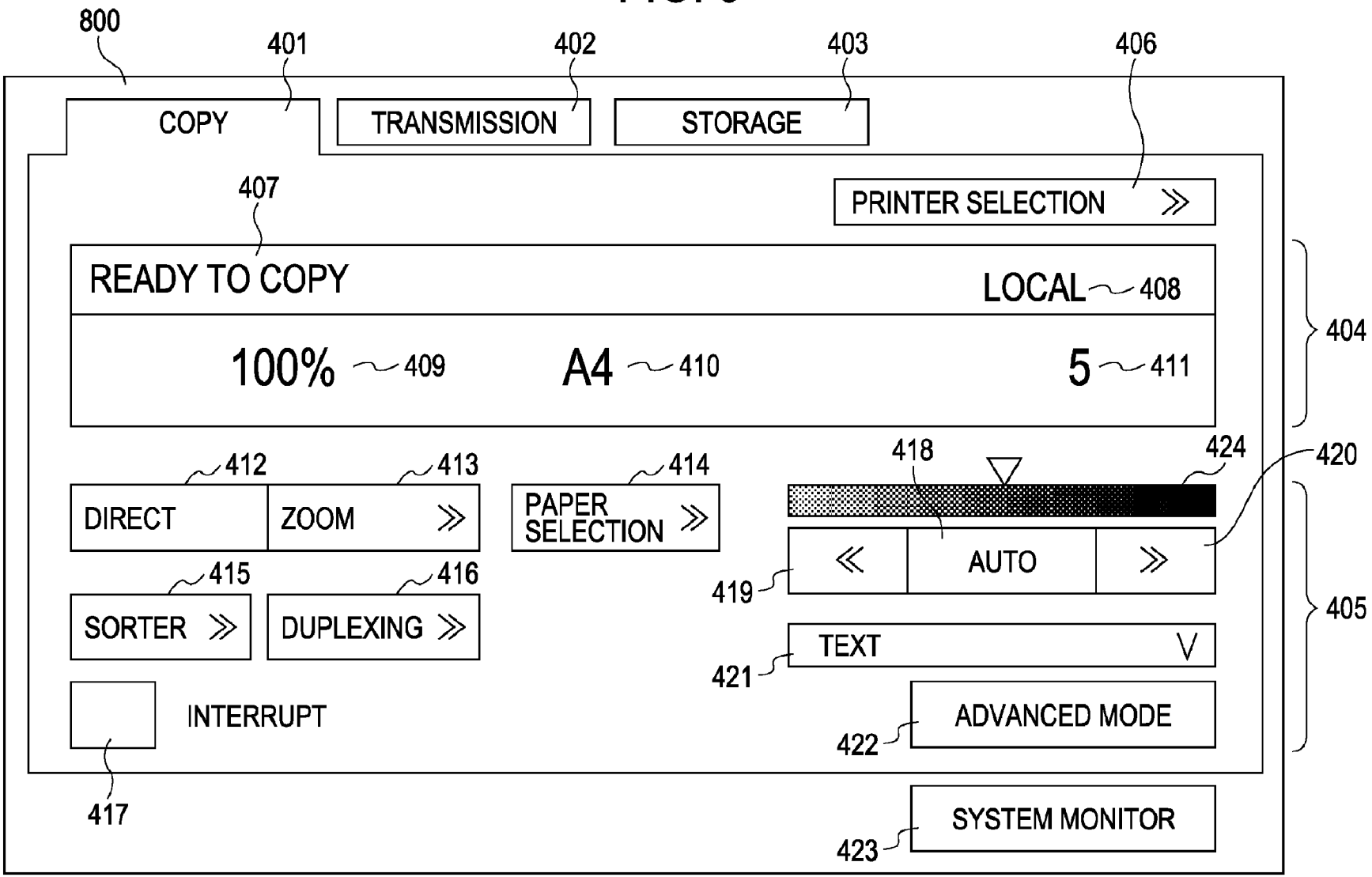
FIG. 5 illustrates an example of an operating unit in the copier according to the first exemplary embodiment.

FIG. 5 illustrates an example of a liquid-crystal touch panel of the operating unit 2012 in the copier 100. Setting user interfaces for a copying function, a transmitting function, and a storing function can be displayed by touching a copy tab 401, a transmission tab 402, and a storage tab 403, respectively. The copying function outputs scanned images to recording sheets. The transmitting function transmits the read images to apparatuses on the network via a communicating unit on an e-mail basis. The storing function stores the scanned images in the HDD 2004.

FIG. 5 illustrates a case when the copy tab 401 is pressed. The copy tab 401 includes a display section 404 displaying the status and settings of the copier and a setting section 405 for copy settings. In the display section 404, the status of the copier, the machine that prints copies, the copy ratio of the output images, the type of the recording sheets, and the number of copies are displayed in areas 407 to 411, respectively. In the setting section 405, various parameters can be set by pressing touch buttons 412 to 422. The copy ratio can be set to 100% by pressing the touch button 412. The touch button 413 opens another screen for setting the copy ratio of the output images. The parameter set via the touch buttons 412 and 413 is displayed in the area 409. The touch button 414 opens another screen for setting the types of the recording sheets. The set parameter is displayed in the area 410. Sorting of the copies and stapling of the copies in the output unit 370 can be set via the touch button 415. Duplex printing can be set via the touch button 416. Interrupt copying, which allows a priority job even when the copier 100 has preceding jobs, can be set by pressing the touch button 417. Color density can be set via the touch buttons 418 to 420. The color density can be adjusted by moving a cursor on a density bar 424 to a desired position using the touch buttons 419 and 420. Moreover, the color density can be set to a default value by pressing the touch button 418. The type of the images to be copied, i.e., text, graph, or photo, can be specified via the touch button 421 such that optimum outputs are obtained. Various complicated settings such as bookbinding and copying originals having different sizes can be made in an advanced mode via the touch button 422. A system monitor button 423 allows the user to view status. Moreover, a printer selection button 406 opens another screen (FIG. 6) for selecting copiers and printers that print copies. The parameter set here is displayed in the area 408.

In addition to the liquid-crystal touch panel, the operating unit 2012 includes a numeric keypad for inputting numbers such as the number of copies. The number of copies set here is displayed in the area 411.

Figure 6:
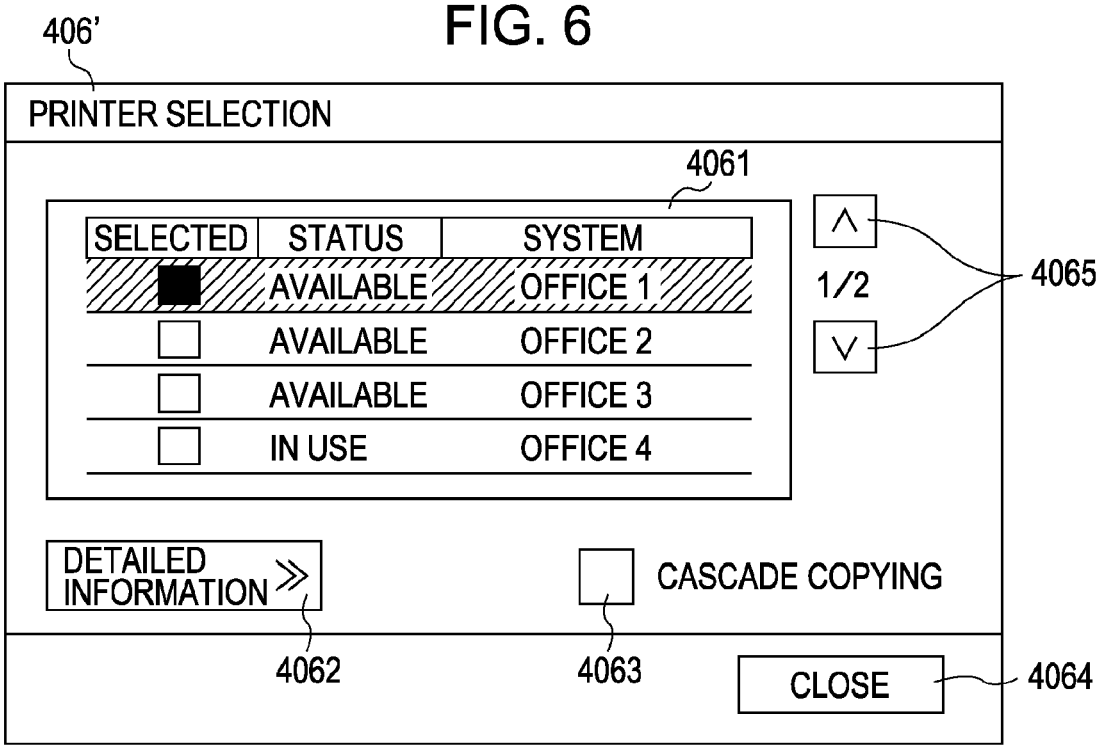
FIG. 6 illustrates an example of a printer selection screen displayed on the operating unit.

FIG. 6 illustrates a printer selection screen 406' opened when the printer selection button 406 is pressed. The printer selection screen 406' allows users of the copier 100 to select machines used for copying. Names and statuses of machines whose IP addresses are registered in the copier 100 as destinations of cascade copying (remote machines) are shown in an area 4061. As shown in FIG. 6, the copier 100 (Office 1) itself is selected by default. The remote machines Office 2 to 4 connected via LAN can be selected as destinations of cascade copying. Buttons 4065 scroll the contents displayed in the area 4061. A button 4062 opens another window that displays detailed information of the machine selected in the area 4061. In addition to the name and the status of use, the detailed information includes options such as a stapling function and a punching function, available paper sizes, and the like. A button 4063 activates the cascade copying function. When this button is pressed while a machine other than the local machine (Office 1) is selected in the area 4061, cascade copying is performed by the selected machine and the local machine (Office 1).

Figure 7:
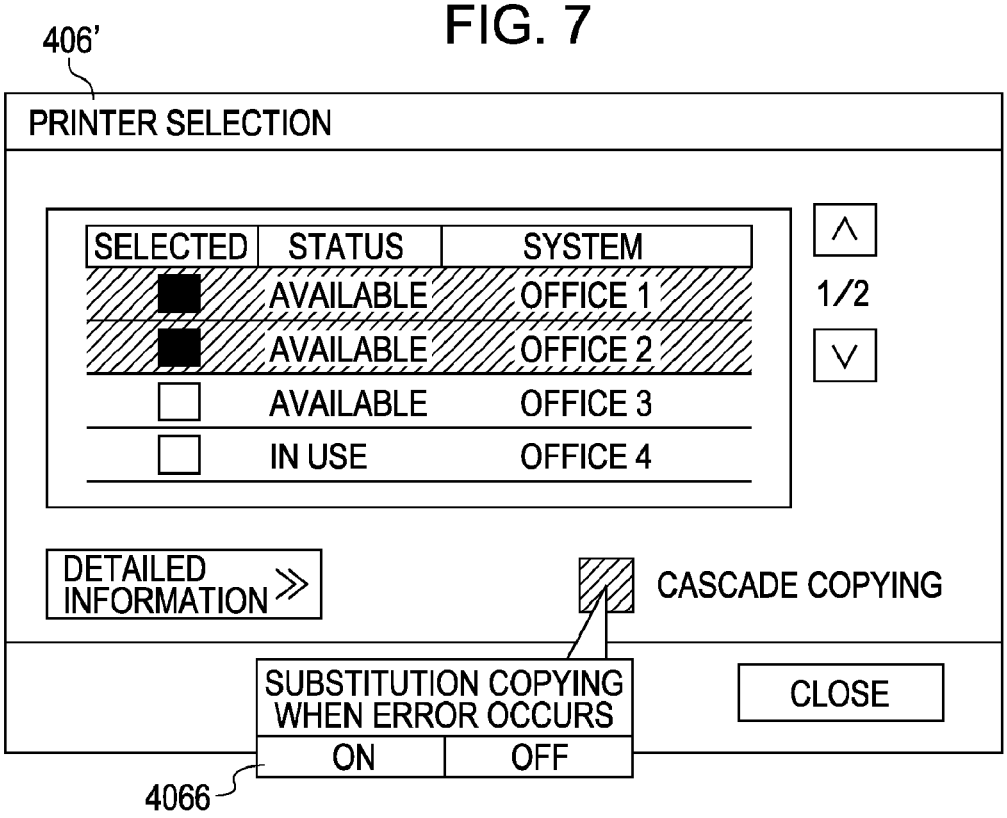
FIG. 7 illustrates another example of the printer selection screen displayed on the operating unit.

FIG. 7 illustrates the printer selection screen 406' when the button 4063 for activating the cascade copying function is pressed. Users can select whether or not substitution copying is performed upon the occurrence of an error during cascade copying by pressing buttons 4066. When an error such as a paper jam, a run out of paper error, and a run out of toner error that prevents continuation of the printing process occurs in one of the machines that print copies during cascade copying while the substitution copying function is set to ON, the rest of the copies can be produced by the other machine. When the substitution copying function is set to OFF, substitution copying is not performed, and the rest of the copies are printed by the machine that had the error after the error is removed from the machine. The settings are completed by pressing a button 4064 after the output machines are selected on the printer selection screen 406', and the screen returns to that shown in FIG. 5.

Figure 8:
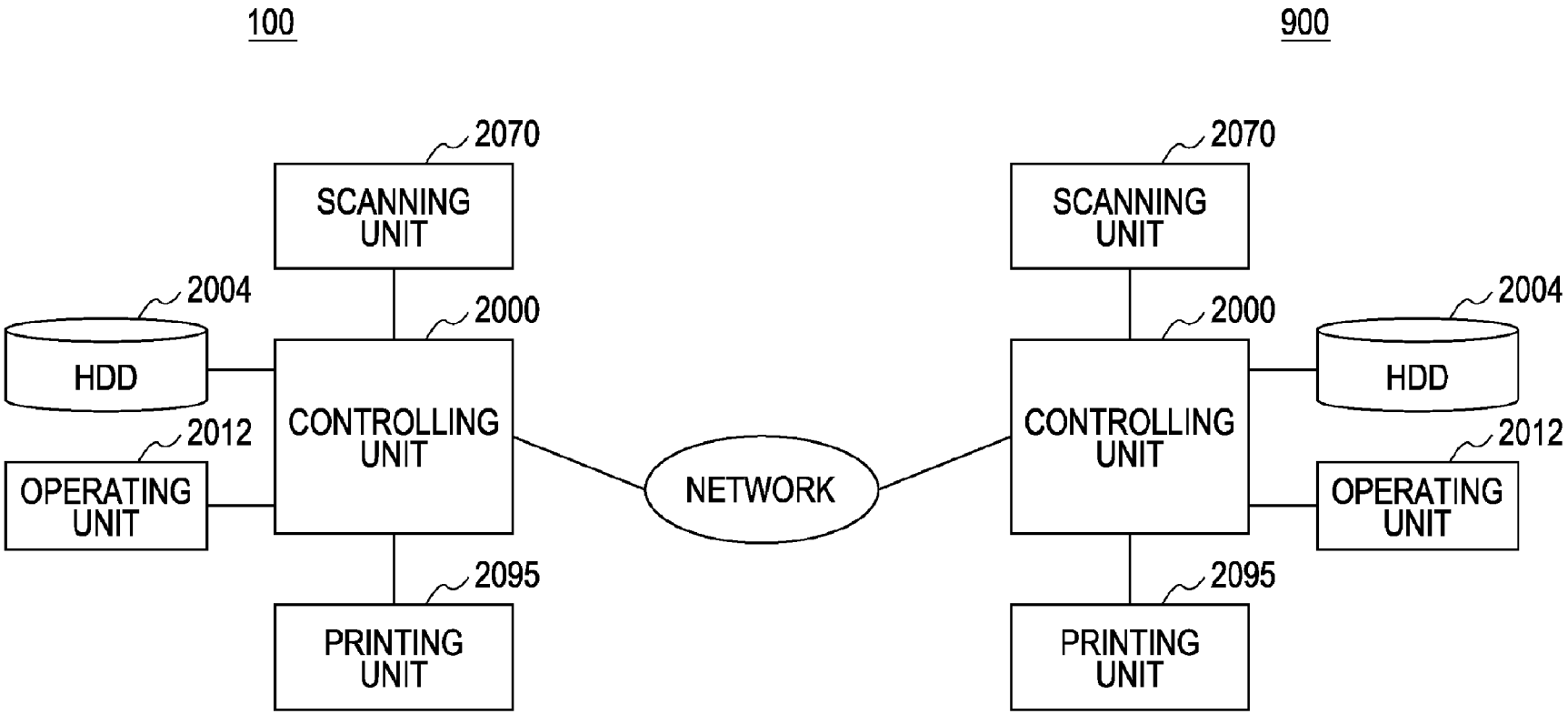
FIG. 8 illustrates the structures of a cascade-copying system according to the first exemplary embodiment.

FIG. 8 illustrates the structures of the copier 100 and the copier 900 shown in FIG. 4. Operations when the copier 100 selects the copier 900 as a destination of cascade copying will now be described with reference to FIG. 8. That is, the copier 100 functions as a local machine, and the copier 900 functions as a remote machine during cascade copying.

A user sets the copier 900 as a destination of cascade copying using the liquid-crystal touch panel of the operating unit 2012 in the copier 100, and then makes other copy settings. Moreover, the user sets the number of copies using the numeric keypad of the operating unit 2012. The user sets an original document to be copied on the document-conveying unit 250 of the scanning unit 2070, and starts copying. First, the CPU 2001 of the controlling unit 2000 in the copier 100 sets half the set number of copies as the number of copies to be printed by the copier 100, and allocates the other half to the copier 900 as the number of copies to be printed by the copier 900. When the number of copies is odd, one additional coy is allocated to the local machine. The scanning unit 2070 reads the original document set on the document-conveying unit 250. The read image data is transferred to the controlling unit 2000 as RGB data when the scanning unit 2070 is a color scanner or as black-and-white data when the scanning unit 2070 is a monochrome scanner. The image-compressing unit 2040 of the controlling unit 2000 compresses the image data using compression techniques suitable for the image data, for example, JPEG for color images and JBIG for monochrome images, and spools the compressed data in the HDD 2004. At the same time, the compressed data spooled in the HDD 2004 is transferred to the copier 900 via the network I/F 2010. At this time, the number of copies to be printed by the copier 900 and various copying information are also transferred to the copier 900. Subsequently, the controlling unit 2000 expands the compressed data read from the HDD 2004, and generates output page data of C, M, Y, and K on which the page data of the original document is laid out according to the settings. The data is sent to the printing unit 2095 in sequence. The printing unit 2095 prints and ejects copies after stapling or binding the copies using the output unit 370 according to the settings. Moreover, the controlling unit 2000 counts the number of ejected copies and the number of ejected pages on the basis of the information of ejected sheets detected by an optical sensor or the like of the printing unit 2095. When the number of ejected copies reaches the number of copies to be printed by the copier 100 set in advance, the copying process is finished.

The copier 900 sends the compressed image data sent from the copier 100 and various copying information such as the number of copies to the controlling unit 2000. The CPU 2001 of the controlling unit 2000 stores the compressed image data in the HDD 2004, and writes the copying information into the register thereof. The printing unit 2095 prints and ejects copies while counting the number of ejected copies and the number of ejected pages as in the copier 100. When the number of ejected copies reaches the number of copies set according to the copying information sent from the copier 100, the copying process is finished.

Through these operations, all the processes of the cascade-copying system are successfully completed.

Figure 9:
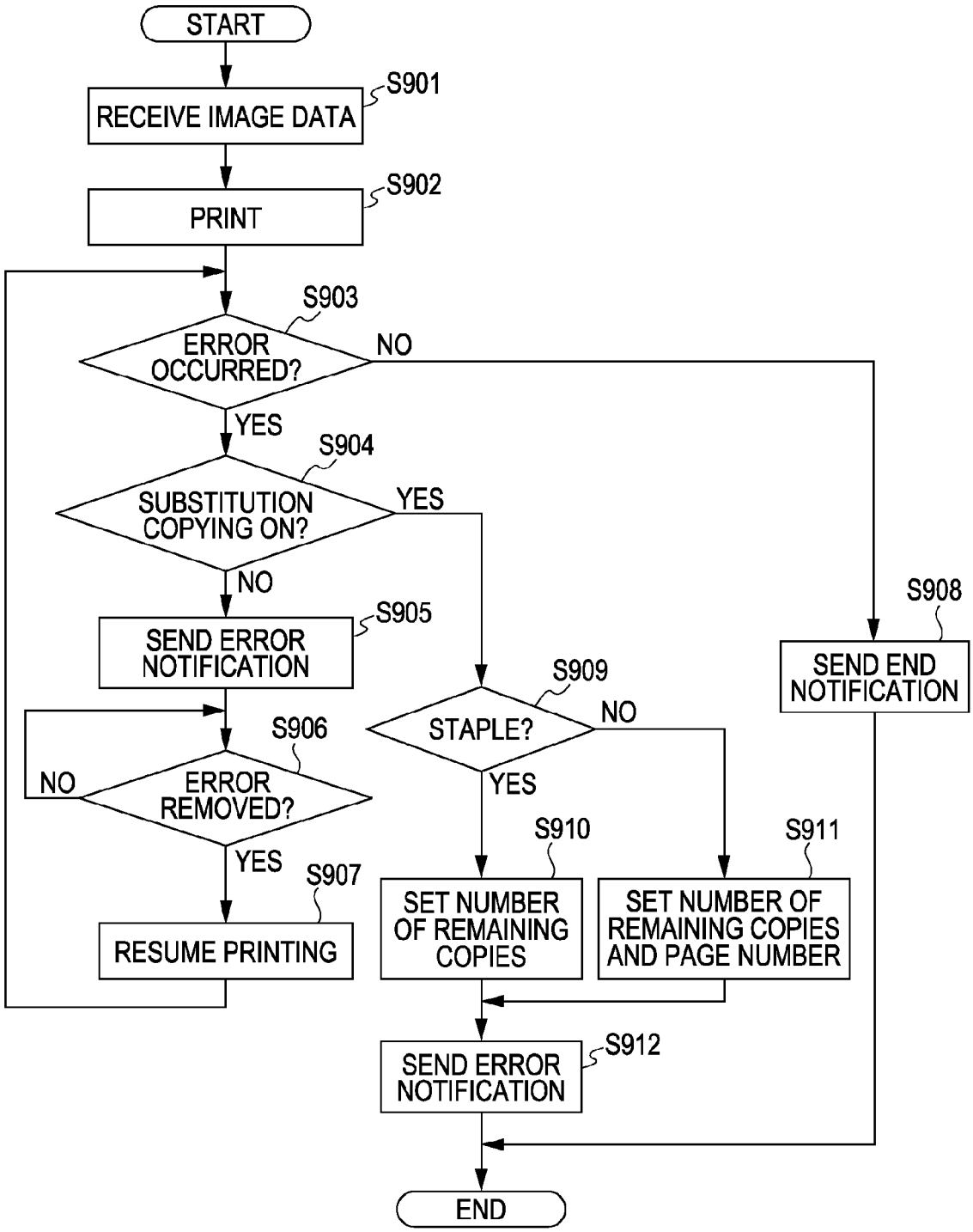
FIG. 9 is a flow chart illustrating operations of a remote machine according to the first exemplary embodiment.

FIG. 9 is a flow chart of operations of a remote machine in the cascade-copying system according to this exemplary embodiment. Steps shown in FIG. 9 are performed by the CPU 2001 of the controlling unit 2000 in a copier serving as a remote machine by controlling functional units thereof on the basis of a computer program stored in the HDD or the ROM.

First, the network I/F 2010 receives image data read and transmitted by the local machine in Step S901. At this moment, the network I/F 2010 also receives identification information that the job is a cascade-copying job, information on the number of copies, and various print setting information (specifications of duplex printing, stapling, N-on-1 copying, output paper sizes, and the like) from the local machine in addition to the image data. Furthermore, the network I/F 2010 also receives information indicating whether or not the substitution copying function is selected.

Next, the printing unit 2095 prints on the basis of the received image data and various setting information in Step S902. After starting printing, the CPU 2001 determines whether or not an error that prevents continuation of the printing process occurred in Step S903. The error includes, for example, a paper jam, a run out of paper error, a run out of toner error, shortage of HDD memory, and a breakdown of a printer drive. When such an error is detected by the CPU 2001 (Yes in Step S903), the process proceeds to Step S904. On the other hand, when the printing is successfully completed without an error (No in Step S903), the process proceeds to Step S908.

In Step S904, the CPU 2001 determines whether or not the substitution copying function is set to ON with reference to the information received in Step S901. That is, it is determined whether or not an instruction that unprinted copies among the copies allocated to the remote machine should be printed by the local machine instead of the remote machine upon the occurrence of an error in the remote machine has been issued. When it is determined that the substitution copying function is set to ON (Yes in Step S904), the process proceeds to Step S909. When it is determined that the substitution copying function is set to OFF (No in Step S904), the process proceeds to Step S905.

In Step S905, the CPU 2001 sends the contents of the error detected in Step S903 to the local machine via the network I/F 2010. In Step S906, the CPU 2001 determines whether or not the error is removed by the user. When the error is removed (Yes in Step S906), the process proceeds to Step S907.

In Step S907, the printing unit 2095 resumes the printing process interrupted by the error and then returns to Step S903 to check for another error. After all the copies allocated to the remote machine are printed, the process proceeds to Step S908.

In Step S908, the CPU 2001 sends a notification of end-of-printing to the local machine via the network I/F 2010. With this, operations of the remote machine when the substitution copying function is set to OFF are completed.

When it is determined that the substitution copying function is set to ON in Step S904, the process proceeds to Step S909. In Step S909, the CPU 2001 determines whether or not a stapling function is selected with reference to the print setting information received in Step S901. The specification of the stapling function can be determined according to the contents of the print settings.

When it is determined that the stapling function is selected (Yes in Step S909), the process proceeds to Step S910. When it is determined that the stapling function is not selected (No in Step S909), the process proceeds to Step S911.

In Steps S910 and S911, the contents of the error notification to be sent to the local machine in Step S912 are set. First, in Step S910, the CPU 2001 determines the ordinal position of the copy currently being printed (hereinafter, "in-process copy") among the specified number of copies when the printing process is interrupted by the error. For example, five copies of an original document having one hundred pages are to be printed, and the printing process is interrupted by an error that occurs while the eightieth page of the third copy is being printed. In this case, it is determined that the third copy was being printed. Subsequently, the CPU 2001 calculates the number of unprinted copies on the basis of the information of the ordinal position of the in-process copy and the specified number of copies. In the above-described case, it is determined that the number of unprinted copies is three on the basis of the information that the third copy was being printed and the specified number of copies is five. The CPU 2001 then sets the number of unprinted copies (three in the above-described case) in the contents of the error notification.

In Step S911, the CPU 2001 determines the ordinal position of the in-process copy among the specified number of copies and the number of pages that have already been printed in the in-process copy when the printing process is interrupted by the error. For example, five copies of an original document having one hundred pages are to be printed, and the printing process is interrupted by an error that occurs after seventy-nine pages of the third copy have already been printed and while the eightieth page is being printed. In this case, it is determined that the third copy was being printed and seventy-nine pages have already been printed. Subsequently, the CPU 2001 calculates the number of unprinted copies excluding the in-process copy on the basis of the information of the ordinal position of the in-process copy and the specified number of copies. That is, the number of copies calculated in this step is less than that calculated in Step S910 by one. In the above-described case, it is determined that the number of unprinted copies is two on the basis of the information that the third copy was being printed and the specified number of copies is five. The CPU 2001 then sets the number of unprinted copies (two in the above-described case) and the number of pages that have already been printed in the in-process copy (seventy-nine in the above-described case) in the contents of the error notification.

In Step S912, the CPU 2001 sends the contents of the error detected in Step S903 and the contents set in Step S910 or S911 to the local machine via the network I/F 2010.

With this, operations of the remote machine when the cascade copying function is set to ON are completed.

When the local machine receives the error notification sent in Step S912, the local machine checks the contents of the error notification. Subsequently, the local machine resets the number of copies already allocated to the local machine so as to perform cascade copying according to the contents of the error notification. When the contents of the error notification include the number of copies that have not been printed by the remote machine, the CPU 2001 of the local machine adds this number to the number of copies already allocated to the local machine and resets the number of copies to be printed. For example, when the number of copies allocated to the local machine is five and the number of copies that have not been printed by the remote machine is three according to the error notification, the number of copies to be printed is reset to eight.

When the contents of the error notification include the number of copies remaining at the remote machine and the number of pages that have already been printed in the in-process process copy, the CPU 2001 of the local machine adds the number of remaining copies to the number of copies already allocated to the local machine, and resets the number of copies to be printed. Furthermore, the CPU 2001 writes the notified page number into the memory, and instructs printing to continue from a page subsequent to this page to the last page of this copy after the copies of the reset number are printed.

With this, the copies that have not been printed by the remote machine can be printed by the local machine when the printing process is interrupted by an error that prevents continuation of the printing process occurring in the remote machine during cascade copying.

Moreover, when the local machine prints instead of the remote machine, the local machine can print the number of copies including the copy interrupted in the remote machine, or can print the number of copies excluding the interrupted copy and the unprinted pages in the interrupted copy according to the print setting whether or not the stapling function is selected during cascade copying. When the stapling function is selected, each single copy is preferably printed by the same machine. When the stapling function is not selected and each single copy is not necessarily printed by the same machine, pages that do not constitute a complete copy printed by the machine having an error are preferably not wasted. According to this exemplary embodiment, substitution copying can be efficiently performed according to these job settings during cascade copying.

Second Exemplary Embodiment

In the first exemplary embodiment, when an error occurs in the remote machine during cascade copying and substitution copying is on, the remote machine determines whether or not the stapling function is selected, and changes the contents of the error notification received by the local machine according to the determination. In contrast, according to a second exemplary embodiment, the local machine that receives the error notification determines whether or not the stapling function is selected, and changes the substitution process according to the determination when an error occurs in the remote machine.

Figure 10:
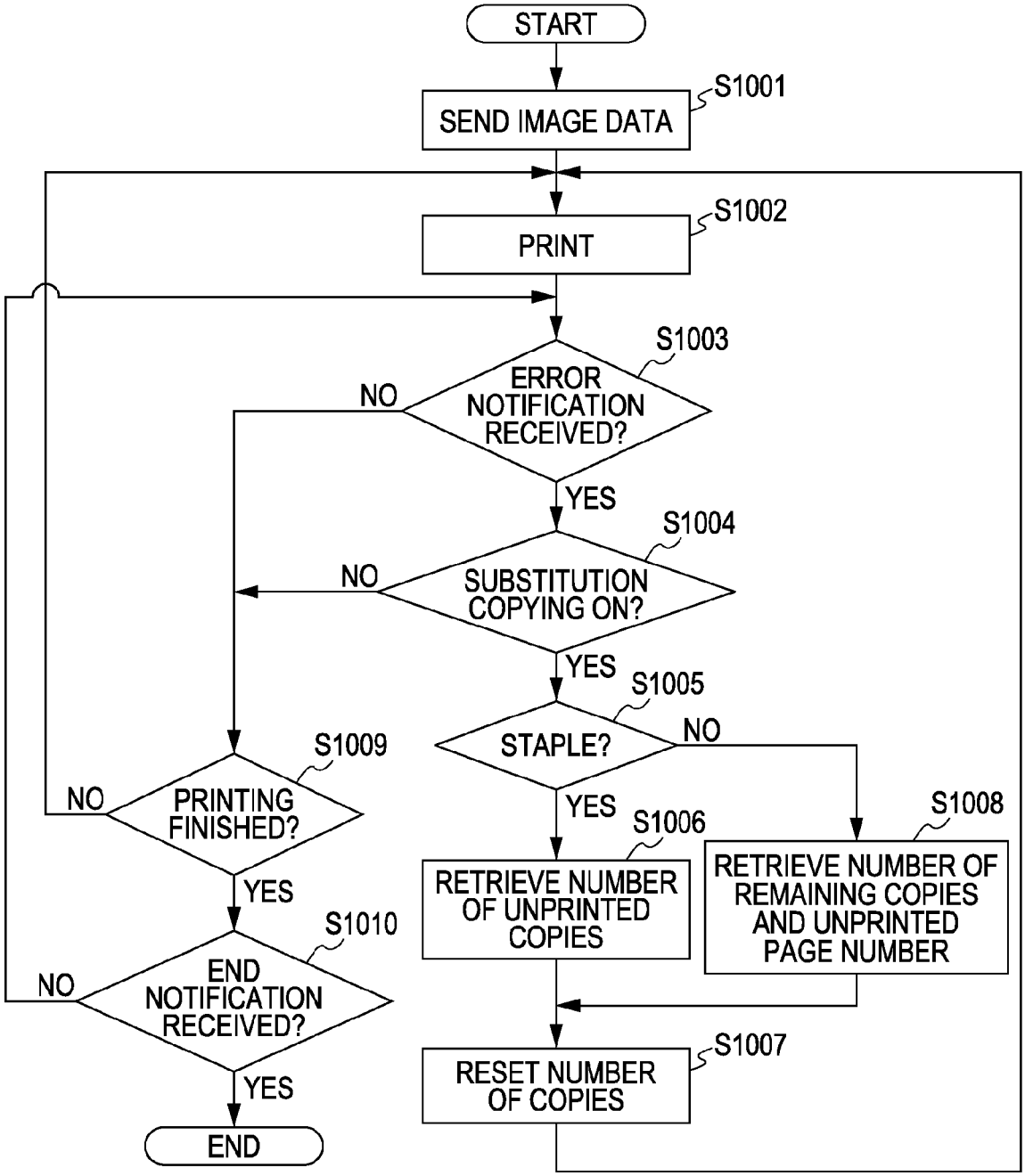
FIG. 10 is a flow chart illustrating operations of a local machine according to a second exemplary embodiment of the present invention.

Operations of a local machine according to this exemplary embodiment during cascade copying will now be described with reference to a flow chart shown in FIG. 10. Steps shown in FIG. 10 are performed by the CPU 2001 of the controlling unit 2000 in a copier serving as a local machine by controlling functional units thereof on the basis of a computer program stored in the HDD or the ROM. The structure of the system and the structures of the copiers capable of operating as a local machine or a remote machine are the same as those in the first exemplary embodiment.

This flow starts when a user operates the operating unit of the local machine so as to input instructions of performing cascade copying and scanning the original document. In Step S1001, the network I/F 2010 transmits the image data scanned and generated at the scanning unit 2070 to a remote machine. At this time, the network I/F 2010 also sends identification information that the job is a cascade-copying job, information on the number of copies, and various print setting information (specifications of duplex printing, stapling, N-on-1 copying, output paper sizes, and the like) in addition to the image data. Furthermore, the network I/F 2010 also sends information indicating whether or not the substitution copying function is selected.

In Step S1002, the printing unit 2095 prints on the basis of the image data and various setting information.

In Step S1003, the CPU 2001 determines whether or not the local machine receives an error notification from the remote machine. When no error notification is received (No in Step S1003), the process proceeds to Step S1009 to determine whether the printing process is complete. When the printing process is completed (Yes in Step S1009), the process proceeds to Step S1010. When the printing process is not completed (No in Step S1010), the process returns to Step S1002 so as to continue the printing process. When it is determined that the printing is completed (Yes in Step S1009), the CPU 2001 determines, in Step S1010, whether or not the local machine receives an end notification from the remote machine. When it is determined in Step S1010 that an end notification is received (Yes in Step S1010), cascade copying is finished. When the end notification is not received (No in Step S1010), the process returns to Step S1003, and the subsequent steps are repeated.

When the local machine receives an error notification from the remote machine (Yes in Step S1003), the process proceeds to Step S1004. In Step S1004, the CPU 2001 determines whether or not the substitution copying function during cascade copying is set to ON. When the substitution copying function is set to OFF (No in Step S1004), the process proceeds to Step S1009. On the other hand, when the substitution copying function is set to ON (Yes in Step S1004), the process proceeds to Step S1005.

In Step S1005, the CPU 2001 determines whether or not a stapling function is selected with reference to the print setting information specified by the user. In Step S1005, when it is determined that the stapling function is selected (Yes in Step S1005), the process proceeds to Step S1006. When it is determined that the stapling function is not selected (No in Step S1005), the process proceeds to Step S1008.

In Step S1006, the CPU 2001 refers to the error notification received from the remote machine in Step S1003, and checks the ordinal position of the in-process copy upon the occurrence of the error (information indicating which copy was being printed when the error occurred) and the number of the page that has not been completely printed when the error occurred. The CPU 2001 then calculates the number of unprinted copies among the number of copies allocated to the remote machine on the basis of the number of copies allocated to the remote machine and the ordinal position of the in-process copy upon the occurrence of the error. For example, five copies of an original document having one hundred pages are to be printed by the remote machine, and the printing process is interrupted by an error that occurs after seventy-nine pages of the third copy have already been printed and while the eightieth page is being printed. In this case, it is determined that the number of unprinted copies is three.

Subsequently, the process proceeds to Step S1007, and the CPU 2001 resets the number of copies to be printed by the local machine. That is, the CPU 2001 adds the number calculated in Step S1006 to the number of copies that has already been allocated to the local machine, and resets the number as the number of copies to be printed. For example, when the number of copies already allocated to the local machine is five and the number of unprinted copies is determined as three in Step S1006, the number of copies to be printed by the local machine is reset to eight.

On the other hand, in Step S1008, the CPU 2001 refers to the error notification received from the remote machine in Step S1003, and checks the ordinal position of the in-process copy upon the occurrence of the error (information indicating which copy was being printed when the error occurred) and the number of the page that has not been completely printed when the error occurred. The CPU 2001 then calculates the number of unprinted copies on the basis of the number of copies allocated to the remote machine and the ordinal position of the in-process copy upon the occurrence of the error. For example, five copies of an original document having one hundred pages are to be printed by the remote machine, and the printing process is interrupted by an error that occurs after seventy-nine pages of the third copy have already been printed and while the eightieth page is being printed. In this case, it is determined that the number of unprinted copies is two. Furthermore, the CPU 2001 checks the number of the page that has not been completely printed when the error occurred. In this case, eighty is retrieved as the page number.

Subsequently, the process proceeds to Step S1007, and the CPU 2001 resets the number of copies to be printed by the local machine. That is, the CPU 2001 adds the number calculated in Step S1008 to the number of copies that has already been allocated to the local machine, and resets the number as the number of copies to be printed. Furthermore, the CPU 2001 writes the page number retrieved in Step S1008 into the memory, and instructs printing to continue from this page to the last page of this copy after the copies of the reset number are printed. For example, in this case, the number of copies to be printed by the local machine is reset to seven, and pages from eightieth page to one-hundredth page of one copy is printed after seven copies are printed by the local machine.

When the number of copies to be printed by the local machine is reset in Step S1007, the process returns to Step S1002, and performs the subsequent steps.

With this, the copies that have not been printed by the remote machine can be printed by the local machine when the printing process is interrupted by an error that prevents continuation of the printing process occurring in the remote machine during cascade copying.

Moreover, when the local machine prints instead of the remote machine, the local machine can print the number of copies including the copy interrupted in the remote machine, or can print the number of copies excluding the interrupted copy and the unprinted pages in the interrupted copy according to the print setting whether or not the stapling function is selected during cascade copying. When the stapling function is selected, each single copy is preferably printed by the same machine. When the stapling function is not selected and each single copy is not necessarily printed by the same machine, pages that do not constitute a complete copy printed by the machine having an error are preferably not wasted. According to this exemplary embodiment, substitution copying can be efficiently performed according to these job settings during cascade copying.

Moreover, according to the second exemplary embodiment, the remote machine is only required to send the ordinal position of the in-process copy upon the occurrence of an error (information indicating which copy was being printed when the error occurred) and the number of the page that has not been completely printed when the error occurred to the local machine. That is, the remote machine is not required to determine whether or not the stapling function is selected, and is not required to change the contents of the error notification according to the determination.

Other Exemplary Embodiments

In the first and second exemplary embodiments, cases in which an error occurred in the remote machine during cascade copying have been described. However, the present invention is also applicable to a case in which an error occurs in the local machine. That is, the number of copies to be printed by the remote machine instead of the local machine can be reset by the remote machine when an error occurs in the local machine during cascade copying.

Moreover, according to the first and second exemplary embodiments, substitution copying is performed in the unit of copy or in the unit of page according to the print setting whether or not the stapling function is selected when an error occurs during cascade copying. However, substitution copying can always be performed in the unit of page regardless of the setting of the stapling function. However, when the stapling function is selected, the copy whose pages are separately output from the local machine and the remote machine is not stapled. With this, odd pages are not stapled, and extra pages are not unnecessarily printed. The copy whose pages are separately output from the local machine and the remote machine can be manually stapled after the user bundles the copy.

According to the first exemplary embodiment, the remote machine notifies the local machine of the number of copies that have not been printed as an error notification. However, the number of copies and pages that have already been printed can be transmitted. Moreover, the above-described cascade-copying system includes only two copiers. However, the present invention is also applicable to a cascade-copying system including three or more copiers by selecting a plurality of copiers as remote machines.

Moreover, storage media including program code (software) that performs the operations shown in FIGS. 9 and 10 according to the above-described exemplary embodiments can be supplied to systems or apparatuses. The program code stored in the storage media can be executed using computers (CPUs or MPUs) in the systems or the apparatuses.

In this case, the program code read out of the storage media achieves the functions according to the above-described exemplary embodiments, and therefore, the storage media in which the program code is stored is included in the present invention.

The storage media for supplying the program code include, for example, floppy disks, hard disks, optical disks, magneto-optical disks, CD-ROMs, CD-Rs, DVD-ROMs, magnetic tapes, nonvolatile memory cards, and ROMs.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the priority of Japanese Application No. 2006-171508 filed Jun. 21, 2006, which is hereby incorporated by reference herein in its entirety.

What is claimed is:

1. An image forming system including a first apparatus and a second apparatus, the first apparatus being configured to read an image of an original document, and the read image data being transmitted to the second apparatus, the image forming system being capable of controlling a printing mode in which printing of a plurality of copies of the read image data is performed using the first apparatus and the second apparatus, the image forming system comprising:

a determining unit configured to determine whether a predetermined function corresponding to one or more of starling and binding each of the plurality of copies is selected on a printing process according to the printing mode in a case that an error occurs while one of the first apparatus and the second apparatus is printing one of the plurality of copies; and a control unit configured to control the other of the first apparatus and the second apparatus to print on the other apparatus a page that was not printed while printing the one copy, without printing a page that was already printed by the one of the first apparatus and the second apparatus in the one copy, in a case where the determining unit determines that the predetermined function is not selected, and to control the other of the first apparatus and the second apparatus to print on the other apparatus a page that was not printed while printing the one copy, while also printing one or more pages which were already printed by the one of the first apparatus and the second apparatus in the one copy, in a case where the determining unit determines that the predetermined function is selected.

2. The image forming system according to claim 1, further comprising:

a printing unit configured to print the image data based on control performed by the control unit, wherein the printing unit prints the read image data in order to print based on control performed by the control unit without receiving image data from the one of the first apparatus and the second apparatus.

3. The image forming system according claim 1, wherein the first apparatus is operable as the second apparatus, and the second apparatus is operable as the first apparatus.

4. The image forming system according claim 1, wherein the one of the first apparatus and the second apparatus is the second apparatus, and the other of the first apparatus and the second apparatus is the first apparatus.

5. An apparatus connected to an other apparatus, comprising:

a receiving unit configured to receive image data read by the other apparatus;

a printing unit configured to print the image data received by the receiving unit based on information on a plurality of copies specified in the other apparatus;

a control unit configured to control a printing mode in which printing of a plurality of copies of the read image data is performed using the other apparatus and the printing unit;

a determining unit configured to determine whether a predetermined function corresponding to one or more of starling and binding each of the plurality of copies is selected on a printing process according to the printing mode in a case that an error occurs while the printing unit is printing one of the plurality of copies; and a notifying unit configured to notify the other apparatus of the one of the plurality of copies in a case that the determining unit determines that the predetermined function is selected, and to notify the other apparatus of the one of the plurality of copies and the number of unprinted pages in the one of the plurality of copies in a case that the determining unit determines that the predetermined function is not selected.

6. An apparatus connected to an other apparatus, comprising:

a reading unit configured to read an image of an original document;

a printing unit configured to print the image data read by the reading unit;

a control unit configured to send the image data read by the reading unit to the other apparatus, and to control a printing mode in which printing of a plurality of copies of the read image data is performed using the other apparatus and the printing unit;

a receiving unit configured to receive information indicating occurrence of an error from the other apparatus in a case that an error occurs in the other apparatus while the other apparatus is printing one of the plurality of copies; and a determining unit configured to determine whether a predetermined function corresponding to one or more of starling and binding each of the plurality of copies is selected on a printing process according to the printing mode in response to the receipt of the information by the receiving unit;

wherein the printing unit prints a page that was not printed in the one copy, without printing a page that was already printed by the other apparatus in the one copy, in a case where the determining unit determines that the predetermined function is not selected, and the printing unit prints a page that was not printed while printing the one copy, while also printing one or more pages which were already printed by the other apparatus in the one copy, in a case where the determining unit determines that the predetermined function is selected.

7. A method for controlling an image forming system including a first apparatus and a second apparatus, the first apparatus being configured to read an image of an original document, and the read image data being transmitted to the second apparatus, the image forming system being capable of controlling a printing mode in which printing of a plurality of copies of the read image data is performed using the first apparatus and the second apparatus, the method comprising:

determining whether a predetermined function corresponding to one or more of starling and binding each of the plurality of copies is selected on a printing process according to the printing mode in a case that an error occurs while one of the first apparatus and the second apparatus is printing one of the plurality of copies; and printing, by the other of the first apparatus and the second apparatus, a page that was not printed while printing the one copy, without printing a page that was already printed by the one of the first apparatus and the second apparatus in the one copy, in a case where it is determined that the predetermined function is not selected, and printing, by the other of the first apparatus and the second apparatus, a page that was not printed while printing the one copy, while also printing one or more pages which were already printed by the one of the first apparatus and the second apparatus in the one copy, in a case where it is determined that the predetermined function is selected.

8. A method for controlling an apparatus connected to an other apparatus, comprising:

receiving image data read by the other apparatus;

printing the image data received based on information on a plurality of copies specified in the other apparatus;

printing, in a printing mode, a plurality of copies of the read image data using the apparatus and the other apparatus;

determining whether a predetermined function corresponding to one or more of starling and binding each of the plurality of copies is selected on a printing process according to the printing mode in a case that an error occurs while printing one of the plurality of copies; and notifying, upon occurrence of the error, the other apparatus of the one of the plurality of copies in a case that it is determined that the predetermined function is selected, and notifying, upon occurrence of the error, the other apparatus of the one of the plurality of copies and the number of unprinted pages in the one of the plurality of copies in a case that it is determined that the predetermined function is not selected.

9. A method for controlling an apparatus connected to an other apparatus, comprising:

reading an image of an original document;

controlling printing by sending the read image data to the other apparatus, and controlling a printing mode in which printing of a plurality of copies of the image data is performed using the apparatus and the other apparatus;

receiving, from the other apparatus, information indicating occurrence of an error in a case that an error occurs in the other apparatus while the other apparatus is printing one of the plurality of copies; and determining whether a predetermined function corresponding to one or more of starling and binding each of the plurality of copies is selected on a printing process according to the printing mode in response to the receipt of the information of the error;

wherein the apparatus prints a page that was not printed in the one copy, without printing a page that was already printed by the other apparatus in the one copy, in a case where it is determined that the predetermined function is not selected, and the apparatus prints a page that was not printed while printing the one copy, while also printing one or more pages which were already printed by the other apparatus in the one copy, in a case where it is determined that the predetermined function is selected.

* * * * *